US005535477A

United States Patent [19]

Witkowski

[11] Patent Number: 5,535,477

[45] Date of Patent: Jul. 16, 1996

[54] VACUUM CLEANER ATTACHMENT

[76] Inventor: Anthony J. Witkowski, 24778 Sarah Flynn Dr., Novi, Mich. 48374-2920

[21] Appl. No.: 168,537

[22] Filed: Dec. 17, 1993

[51] Int. Cl.[6] ..... A47L 9/02

[52] U.S. Cl. ..... 15/395; 15/401; 15/415.1

[58] Field of Search ..... 15/393, 395, 401, 15/415.1

[56] References Cited

U.S. PATENT DOCUMENTS

| | | | |
|---|---|---|---|
| 986,245 | 3/1911 | Thurman | 15/415.1 |
| 1,831,328 | 11/1931 | Thamm | 15/395 |
| 2,811,738 | 11/1957 | Gall | 15/395 X |
| 3,015,336 | 1/1962 | Caples | 15/415.1 X |
| 3,777,330 | 12/1973 | Van Huffel | 15/304 X |
| 4,715,088 | 12/1987 | Haase | 15/395 X |
| 5,046,217 | 9/1991 | Cornell et al. | 15/395 X |
| 5,060,341 | 10/1991 | Nelle | 15/415.1 X |

*Primary Examiner*—Chris K. Moore
*Attorney, Agent, or Firm*—Howard & Howard

[57] ABSTRACT

A unique vacuum cleaner attachment specifically configured for dust removal from the interior of any 3½ inch (88.9 mm) disk drive unit, commonly found in conjunction with electronic computer and word processor equipment. The attachment comprises a vacuum cleaner hose fitting at one end running parallel to a hollow body member which allows for grasp along its length and terminates at opposite end after gradually being reduced in diameter and increased in width from the grasp portion so as to provide a hollowed disk for insertion. On the exterior of the attachment's top and bottom sides, which are symmetrical and thus reversable, find positive stops located at the points where the diskette shaped configuration begins and centered along that plane.

5 Claims, 2 Drawing Sheets

VACUUM CLEANER ATTACHMENT

BACKGROUND OF THE INVENTION

1. Field of the Invention

The invention relates to attachment devices which derive their suction from the hose of a vacuum cleaner, this novel one being configured for use inside any 3½ inch (88.9 mm) disk drive unit.

2. Description of the Prior Art

To date brandnames of computers and word processors number in the thousands. Many of these manufacturers provide a 3½ inch (88.9 mm) diskette or commonly called disk, drive unit. Certain manufacturers do not provide a port door, allowing dust to gain entry. The manufactured units that do have a door for their disk drive port still allow dust and small particles to enter these units via diskette usage. This dust interferes with the data stored and used from diskettes inserted into the disk drive unit.

My novel invention of providing unique attachment cleaner tool for 3½ inch (88.9 mm) disk drive units will provide usefullness to countless people. Unlike a head cleaner tool which functions only to clean a disk drive head, my invention offers an avenue to clean the major interior of the diskette shaped drive unit, once suction is being derived through the hose attachment end. The disk portion of the attachment is inserted into the disk drive unit until one or both of its positive stops come in contact with the disk drive unit's housing. The attachment can then be withdrawn, providing a safe and effective removal of dust and dust like particles from the disk drive unit's major interior.

There are a plurality of vacuum cleaner attachments which are usable when connected to the free end of a hose providing suction. These various patented attachments are designed for different cleaning purposes. My novel attachment invention is not like any other known vacuum cleaner attachment. Mine is specifically intended for insertion into any 3½ inch (88.9 mm) disk drive unit. However, in exhausting a patent search certain other patents having vague characteristic similarities need to be discounted. U.S. Pat. Nos. 4,694,529; 4,989,294; and 4,553,284 are noteworthy.

In U.S. Pat. No. 4,694,529, Choiniere discloses an attachment with intentions of dust removal from under household appliances. The socket portion of his device is vaguely similar in that the top half if made aerodynamic would almost resemble a portion of my attachment. Clearly the overall shape and intentions are dissimilar.

U.S. Pat. No. 4,989,294 discloses a plastic floor tool which is formed from two separate injected molded plastic pieces that are configured, so when joined define the aerodynamically shaped interior chamber of the tool. Obviously the floor tool Fisher describes in this patent could never be inserted into a 3½ inch (88.9 mm) disk drive unit. Unlike Fisher's my attachment has acute bends in the air flow path as well as interior support members, besides aerodynamic aspects, as air is funneled through the disk portion of the attachment and back toward the hose connection. When dealing with moving air it is intuitive that one utilize as much aerodynamics as possible.

Lastly in U.S. Pat. No. 4,553,284 Strumbos describes a universal nozzle that is capable of being manually deformed and yet has sufficient resiliency to regain its original configuration. It is questionable if indeed this nozzle was forced into the 3½ inch (88.9 mm) disk drive unit, if it could be retrieved without harming any of the mechanisms it would come in contact with. My attachment is of fixed position nature and unlike Strumbos', requires no lateral or horizontal moving once inserted, to clean the major interior of the disk drive unit. My attachment's positive stops act as a fail-safe, preventing over insertion, and any possible damage to the disk drive unit.

SUMMARY OF THE INVENTION

It is the object of the invention to provide a vacuum cleaner attachment which enables aspirating dust particles and the like, from the major interior of any 3½ inch (88.9 mm) disk drive unit. This is accomplished by insertion of said attachment to the point where one or both of its positive stops rest against the disk drive unit's housing, and no lateral or horizontal moving of said attachment being required or possible once inserted.

The configured attachment is made of a plastic or like semirigid material and consists of a longitudinally located grasping point midway between the hose connection end portion, and the joining section that leads into the open ended diskette shaped portion. The diskette shaped portion's opening is longitudinally centered relative to the opposite end's hose connection portion. Preferably, the opening of the diskette portion has a transverse consisting of its greater dimension center opening and one lesser dimension at an approximately forty-five degrees adjacent to each side of said greater dimension center opening. This allows for frontal and side directional cleaning of the major interior of the disk drive unit upon attachment insertion.

Commencing from the grasp connection portion is the aerodynamic joining section, which gradually tapes and is reduced in diameter and increased in width, so as to provide a hollowed continuous air flow chamber leading into the hollowed diskette shaped portion. Said diskette shaped portion having a width of 3½ inches (88.9 mm), length of 3¼ inches (82.5 mm), and providing an outer diameter end opening of ⅛ of an inch (3.2 mm). The diskette shaped portion's chamber is hollow save some eight interior support members which are themselves an integral part of the attachment's diskette shaped portion, and function to retain shape.

On the exterior of the attachment's top and bottom sides find a positive stop located at the point where said diskette shaped configuration begins and centered along that plane's axis with said positive stop running back along the tapered hollow body member at a sloped approximate forty-five degree angle, terminating before the grasp portion. Said positive stops' protrusion obtain a maximum height of 7/16 of an inch (11.2 mm) above the flat diskette portion's exteriors, and have a ½ of an inch (12.7 mm) of thickness.

DETAILED DESCRIPTION

Figure 1:
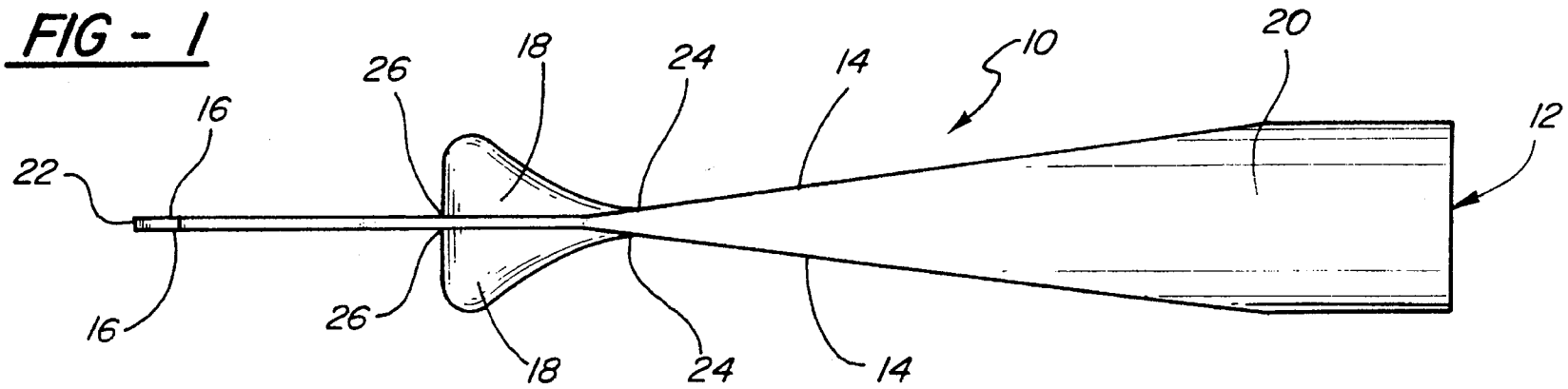
FIG. 1 is a longitudinal partial sectional view illustrating the preferred embodiment of the invention.
Figure 2:
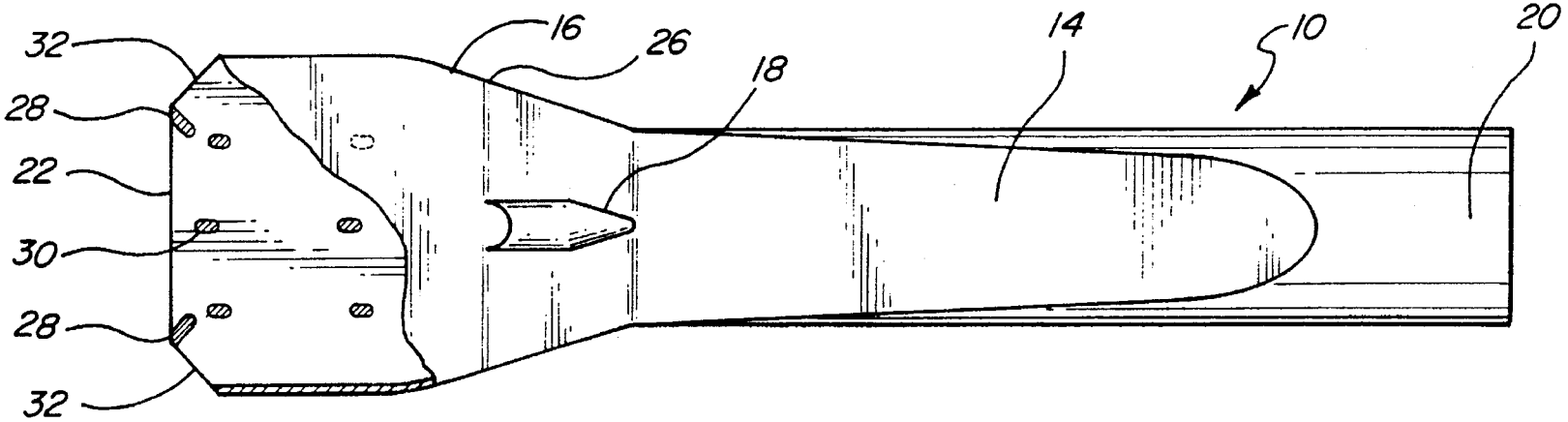
FIG. 2 is a top plan view of the attachment invention with a portion broken out to expose the diskette portion's interior support members.

FIG. 1 illustrates a preferred embodiment of the vacuum cleaner attachment indicated generally at 10. The invention is attached to an end of a vacuum cleaner's wand (not shown), at point 12 by means of manually forcing the tapered or sized wand into the invention's interior diameter at 12. In use of the invention, the operator grasps the attachment's exterior diameter at points 14. Although FIG. 2 is listed as a top plan view and FIG. 4 as a bottom plan view, in use these two sides are functionally reversable because they are configured symetrically.

The disk shaped 16 opened end 22 of the novel attachment invention is inserted into any electronic unit's 3½ inch disk drive until one or both of the positive stops 18 rest against the units housing. Although not shown, it is understood that the 3½ inch (88.9 mm) disk drive unit may be resting horizontally or vertically in its housing and thus the attachment shall be so minipulated to correspond, allowing insertion up to one or both of said attachment's positive stops 18.

The body 10 is preferably constructed of a plastic material although other material or material combinations that produce a semirigid end-product can alternatively be used. This body 10 has a longitudinally extending interior chamber 20 formed along the entire length of the body 10 and, in the preferred form of the invention, this chamber 20 begins at 12 as being cylindrical in shape and open ended. This cylindrical shape gives way to a tapered grasping section 14 which is configured to have an aerodynamically shaped interior chamber. Continuing along the traverse of this attachment the grasping section 14 gives way to a narrow section which is gradually tapered and reduced in diameter and increased in width as compared to 14, in order it's dimensions align uniformly with the disk portion's dimensions of the attachment 16. The diskette shaped portion's opening 22 is longitudinally centered relative to the opposite end's hose connection portion 12.

Referring again to FIG. 1 find on the exterior of the attachment's top and bottom sides a-positive stop 18. Said stop is located where the diskette shaped portion of the attachment begins 26 and centered along that plane's axis and said stop's height 7/16 of an inch (11.2 mm) is perpendicular to the disk portion's plane. Said positive stop 18 is ½ of an inch (12.7 mm) thick and runs back along the aerodynamic hollow body member 20 at a sloped approximate forty-five degree angle, terminating before the grasp portion of the attachment 14.

Best shown in FIG. 2, in the preferred form of the invention 10 is the view of the disk portion's interior support members 28 and 30. These integral support members 28 and 30 number eight so as to provide the attachment 10 adequate shape retension in the diskette shaped portion's 16 dimensions.

There are two sets of three support members 30 centered along lines 6—6 and 8—8 illustrated in FIG. 2, with the center support member of each set 30 fifty percent off the center line of each set, and thus located closer to the open end of the tool 22. These support members 30 run parallel to the longitudinal air flow and perpendicular to the axis along the open end 22. The remaining two support members 28 are located one at each end of the greater dimension opened end of the diskette portion 22, centered at the point where the lesser forty-five degree adjacent dimension begins and said support members 28 have a corresponding forty-five degree angle as its lesser dimension open end. These interior support members 28 and 30 should have an approximate width of ⅛ of an inch (3.2 mm) and an approximate length of ¼ of an inch (6.4 mm).

Figure 4:
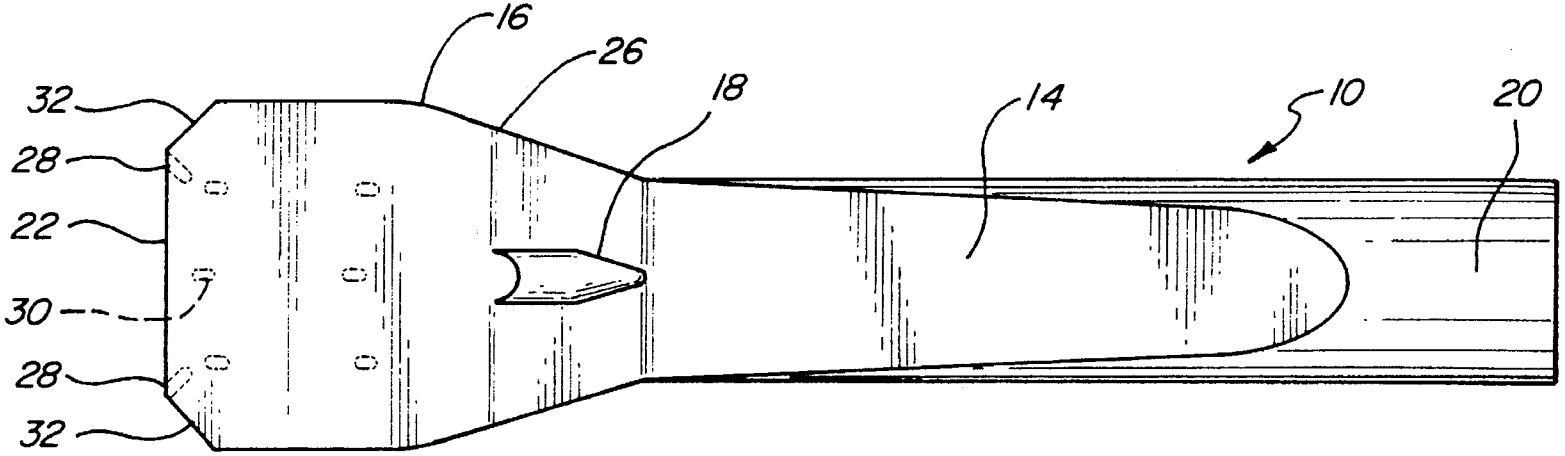
FIG. 4 is a bottom plan view of the attachment invention.

FIG. 4 is a bottom plan view of the attachment invention 10. In use FIG. 2 and FIG. 4 are substitutable.

Figure 3:
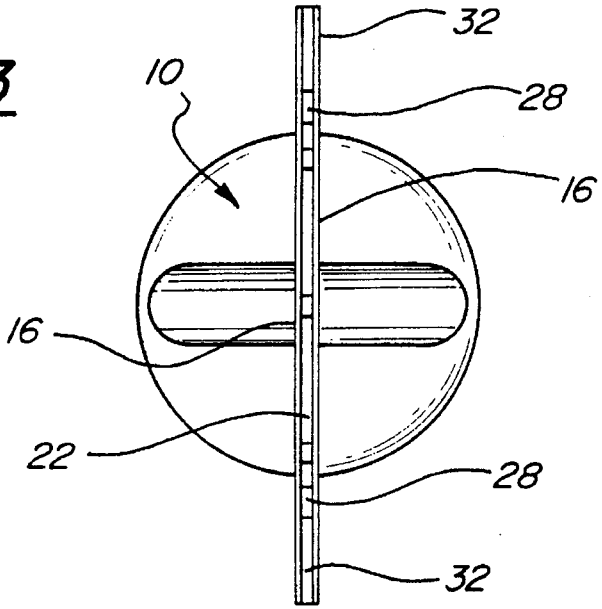
FIG. 3 is a front end view of the attachment invention.

FIG. 3 is a frontal perspective view of the attachment invention. The hose connection end portion 12 has an interior diameter of 1¼ inches (31.8 mm) and has a smooth surface exterior to aid in accomodating adaptors for using other size vacuum wands, or hoses.

FIG. 3 depicts the opening of the diskette shaped portion 22 of the attachment 10. This opening interior diameter 22, or more precisely the space between the walls of the diskette shaped portion 22 measures 1/16 of an inch (1.6 mm), with the walls of the diskette shaped portion 16 having a thickness of 1/32 (0.8 mm) each, for a combined overall thickness or outer diameter of the disk like portion of ⅛ of an inch (3.2 mm). The transverse greater open end dimension along 22, measures 2½ inches (63.5 mm) in width with each lesser adjacent open end dimension 32 measuring ½ an inch (12.7 mm) in width, for a combined overall width of 3½ inches (88.9 mm). The length of the diskette shaped portion 16 of the tool 10 from the open end 22 to the axis of the positive stops 26 measures 3¼ inches (82.5 mm).

The attachment invention having the mentioned dimensions and configuration is thus advantageous in several different respects. First, since the open end portions 22 and 32 are so configured, dust is drawn into the vacuum attachment 10 from the disk drive major interior along three directions simultaneously.

Another further advantage of the attachment invention is that a grasping portion 14 is incorporated into the body 10 allowing ease of handling.

Another further advantage of the attachment invention is its ability to extend time intervals that manufacturers of disk drive components suggest for component scheduled maintenance, due to the attachment's ability to clean the major interior of the disk drive.

A still further advantage of the attachment invention is its ability to be manufactured using inexpensive plastic or like material and thus marketed at an inexpensive price to consumers.

Having described my attachment invention however, many modifications thereto will become apparent to those skilled in the art to which it pertains without deviation from the spirit of the invention as defined by the scope of the appended claims.

What is claimed is:

1. A vacuum cleaner attachment for aspirating dust particles and the like from the interior of an electronic disk drive unit, the disk drive unit having a rectangular opening for receiving a conventional computer diskette, comprising:

a longitudinally extending body having a vacuum chamber extending between an attachment end and an open end, said attachment end having a contour adapted to be connected to a vacuum hose of a vacuum cleaner;

a grasp portion on opposing sides of said longitudinal body spaced from and extending partially between said attachment end and said open end; said grasp portion tapering in diameter from said attachment end to said open end and defining symmetrical top and bottom grasp surfaces for the user to grasp said attachment;

a diskette shaped portion extending from said grasp portion to said open end and having a predetermined rectangular contour conforming to the rectangular opening of the disk drive unit for insertion into the rectangular opening;

said vacuum cleaner attachment characterized by said diskette shaped portion including first and second spaced apart walls defining a vacuum passageway and a plurality of interior support members fixedly secured and extending between said first and second walls for retaining the spaced distance between said walls of said vacuum passageway.

2. A vacuum cleaner attachment as set forth in claim 1 further characterized by including a pair of exterior positive stops on opposing sides of said longitudinal body between said tapered end of said grasp portion and said diskette shaped portion; said positive stops spaced a predetermined distance from said open end for abutting with the exterior opening of the disk drive unit to restrict excessive insertion of said attachment into the disk drive unit.

3. A vacuum cleaner attachment as set forth in claim 2 further characterized by said positive stops fixed along the center axis of said longitudinal body and sloping outwardly from said tapered grasp portion to a terminating portion adjacent said diskette shaped portion.

4. A vacuum cleaner attachment as set forth in claim 1 or 2 further characterized by said diskette shaped portion including a pair of angled openings adjacent to opposing sides of said open end and having a support member aligned at least partially transverse to said longitudinal vacuum chamber between said open end and each of said angled opening for retaining the distance between said walls at said open end.

5. A vacuum cleaner attachment as set forth in claim 4 further characterized by said diskette shaped portion having a width of 3½ inches, a length from said open end to said positive stops of 3¼ inches and a thickness between said first and second walls of ⅛ inch.

* * * * *